US005757280A

United States Patent [19]

Motohashi

[11] Patent Number: 5,757,280

[45] Date of Patent: May 26, 1998

[54] STRUCTURE OF A SELECTIVE CALLING RECEIVER TO CONNECT WITH A VIBRATION ANNUNCIATOR

[75] Inventor: Teruyuki Motohashi, Tokyo, Japan

[73] Assignee: NEC Corporation, Tokyo, Japan

[21] Appl. No.: 724,913

[22] Filed: Oct. 2, 1996

Related U.S. Application Data

[63] Continuation of Ser. No. 266,595, Jun. 28, 1994, abandoned.

[30] Foreign Application Priority Data

Jun. 28, 1993 [JP] Japan ..... 5-178528

[51] Int. Cl.[6] ..... G08B 5/22

[52] U.S. Cl. ..... 340/825.46; 455/38.2; 340/407.1; 340/825.44

[58] Field of Search ..... 340/825.46, 825.47, 340/825.44, 407.1, 333, 311.1; 455/38.2, 34.8; 327/365, 376, 377; 320/3, 4, 15, 6, 19, 48; 307/18; 318/16

[56] References Cited

U.S. PATENT DOCUMENTS

| | | | |
|---|---|---|---|
| 4,160,934 | 7/1979 | Kirsch | 340/333 |
| 4,667,142 | 5/1987 | Butler | 320/6 |
| 4,879,759 | 11/1989 | Matsumoto et al. | 455/348 |
| 5,172,045 | 12/1992 | Takeyasu | 320/15 |
| 5,194,857 | 3/1993 | Gomez | 340/825.44 |
| 5,272,475 | 12/1993 | Eaton et al. | 340/825.46 |
| 5,343,092 | 8/1994 | Dhong et al. | 327/377 |
| 5,353,017 | 10/1994 | Suzuki et al. | 340/825.46 |

FOREIGN PATENT DOCUMENTS

| | | | |
|---|---|---|---|
| 3125964 | 7/1981 | Germany | 340/825.46 |
| 0159834 | 7/1986 | Japan | 340/825.46 |
| 515059 | 1/1993 | Japan . | |
| 9315590 | 8/1993 | WIPO | 340/825.44 |

*Primary Examiner*—Michael Horabik
*Assistant Examiner*—Edward Merz
*Attorney, Agent, or Firm*—Sughrue, Mion, Zinn, Macpeak & Seas, PLLC

[57] ABSTRACT

The present invention is a selective calling receiver comprising: a receiver having a power source; a vibration means having a secondary power source charged by the power source and a vibration generation source operated by the secondary power source; a first cord for connecting the receiver and the vibration means so as to enable the power source to charge the secondary power source and control operation of the vibration generation source; and a second cord for connecting the receiver and the vibration means so as to be used as a ground wire. The present invention can offer a receiver connecting the vibration generation section and the main body of receiver with two electric wires and additionally enabling cost reduction and miniaturization of the receiver.

20 Claims, 5 Drawing Sheets

STRUCTURE OF A SELECTIVE CALLING RECEIVER TO CONNECT WITH A VIBRATION ANNUNCIATOR

This is a Continuation of application Ser. No. 08/266,595 filed Jun. 28, 1994, now abandoned.

BACKGROUND OF THE INVENTION

The present invention relates to a selective calling receiver (hereinafter referred to as a receiver), especially to a selective calling receiver constituted from a main body of receiver and a vibration annunciator.

The latest type of receiver is planned to be miniaturized so as to be convenient for carrying. The card type receiver is popular, and a receiver which signals using vibration so as not to bother another person is especially popular.

However, a motor for the vibrator is necessary in order to signal by vibration. As it is difficult to integrate this kind of motor with a card type receiver, a type of receiver has been proposed which is comprised of a vibration generation section separate from a main body of receiver and a connection between them.

Some receiver types proposed are, for example, a type that combines a vibration generation section with a main body of receiver and integrates them, and a type that separates a vibration generation section from a main body of receiver and then connects them with a cord (electric wire).

From the view point of handling, the integrated type comprised of a vibration generation section together with a main body of receiver is convenient. But the structure of the receiver is large in this case and portability may be comprised. Accordingly the structure connecting both parts with a cord is preferable.

When a main body of receiver is connected to a vibration generation section with a cord in this way, it is necessary to integrate a large scale battery as a power source for the vibration generation section Thus, the size of the vibration generation section becomes large because power consumption of the motor for the vibrator constituting vibration generation section is large. Consequently, the device is not convenient to carry. To solve this problem, a method of integrating a battery in to a main body of receiver as a power source for a vibration generation section can be considered a method using a battery in the main body of receiver can also be considered.

However, when a power source for a vibration generation section is integrated in to a main body of receiver, two units of batteries must be integrated in to the main body of the receiver. However, it is impossible to integrate two batteries in to a card type receiver due to the size.

Also, an air zinc cell is usually used as a power source of a card type receiver. The use of this type of battery is not preferable as a power source for a large power consumption device such as a motor for a vibrator.

For this reason, as mentioned in the Japanese Patent Laid-Open No.5-15059 (1993), an attempt is made to integrate a rechargeable secondary battery in to a vibration generation section, charge this secondary battery using a battery integrated in a main body of receiver, and thus respond to a large power consumption of the vibration generation section.

FIG. 5 is a circuit diagram showing a rechargeable configuration integrating a secondary battery in to a vibration generation section.

With such a configuration, the transistor 52 is off, the transistor 53 is on and the motor 54 does not operate when a drive signal is not output by the main body circuit 51. And the power source 56 of the vibration generation section is charged by the power source 55 of the main body circuit 51 through the transistor 53.

On the other hand, when a drive signal is output by the main body circuit 51, the transistor 52 turns on. The transistor 53 turns off simultaneously. Then, the charging by the power source 55 of the power source 56 of the vibration generation section is stopped, so that the motor 54 is driven only by the power source 56 of the vibration generation section.

The following three kinds of cords are necessary, however, to realize the above-mentioned operation; that is, to connect the vibration generation section with the main body of receiver 51:

(1) A power source line for charging the secondary battery.

(2) A signal line for on-off controlling the vibration generation section.

(3) A common grounding line.

Also the 3-pole connector 57 is additionally necessary to connect these electric wires. The following problems arise in this case: a lot of cords are necessary, using a small connector is difficult, and the cost increases and the size of the receiver becomes large.

SUMMARY OF THE INVENTION

An object of the present invention is, therefore, to provide a selective calling receiver which connects the vibration generating section and the main body of the selective calling receiver with two lines.

Moreover, another object of the present invention is to provide a vibration system which connects the control section which operates the vibration system and the vibration system with two lines.

According to the present invention, it is preferably comprised of a receiver having a power source; a vibration means having a secondary power source charged by the power source and a vibration generation source operated by the secondary power source; a first cord for connecting the receiver and the vibration means to enable it to charge the secondary power source and control the operation of the vibration generation source; and a second cord for connecting the receiver and the vibration means as a ground wire.

In the present invention, as described as above, one of the cords connecting the vibration generation section and the main body of receiver selectively functions as a line for supplying power from the battery built-in the main body of receiver to the secondary battery, or a line for controlling the vibration generation section.

Accordingly, the present invention enables the use of off-the-shelf cords, cost reduction and miniaturization of the selective calling receiver since it enables the use of a two-pole connector.

BRIEF DESCRIPTION ON DRAWINGS

DETAILED DESCRIPTION OF THE INVENTION

Next, referring to drawings the present invention is explained.

Figure 1:
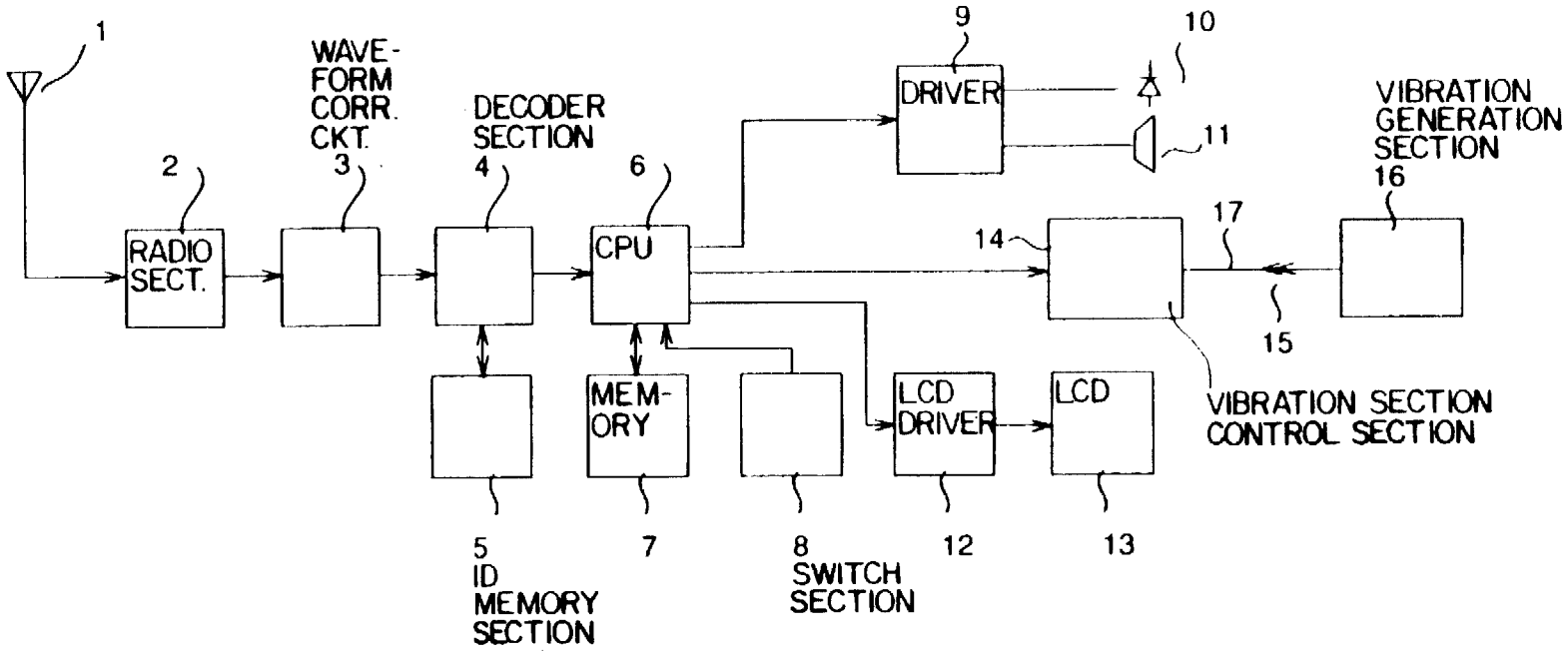
FIG. 1 is a block diagram of an embodiment of the present invention.

FIG. 1 is a block diagram showing a configuration of an embodiment of the present invention.

A radio signal (calling signal) received by the antenna 1 is amplified and demodulated in the radio section 2.

A demodulated signal is converted into a digital signal in the waveform correction circuit 3 and is collated with its own call number stored in the ID memory section 5 in the decoder section 4.

When its own call number has been received, a signal indicating reception of the signal is output to the CPU 6.

Having received this signal from the decoder section 4, the CPU 6 outputs a control signal to the driver section 9 to signal the fact that calling has occurred using light and sound by driving the LED 10 and the speaker 11.

Moreover, when a message is contained in the signal received, the control signal is output to the LCD driver 12 and the message is displayed on the LCD 13. This message is stored by the CPU 6 in the memory 7 and it can be displayed again afterwards.

The switch section 8 carries out suspension of signalling, read, selection and delete of message, and selection of signaling mode.

Furthermore, the vibration generation section 16 provides signaling means in addition to the LED 10 and speaker 11.

Figure 2:
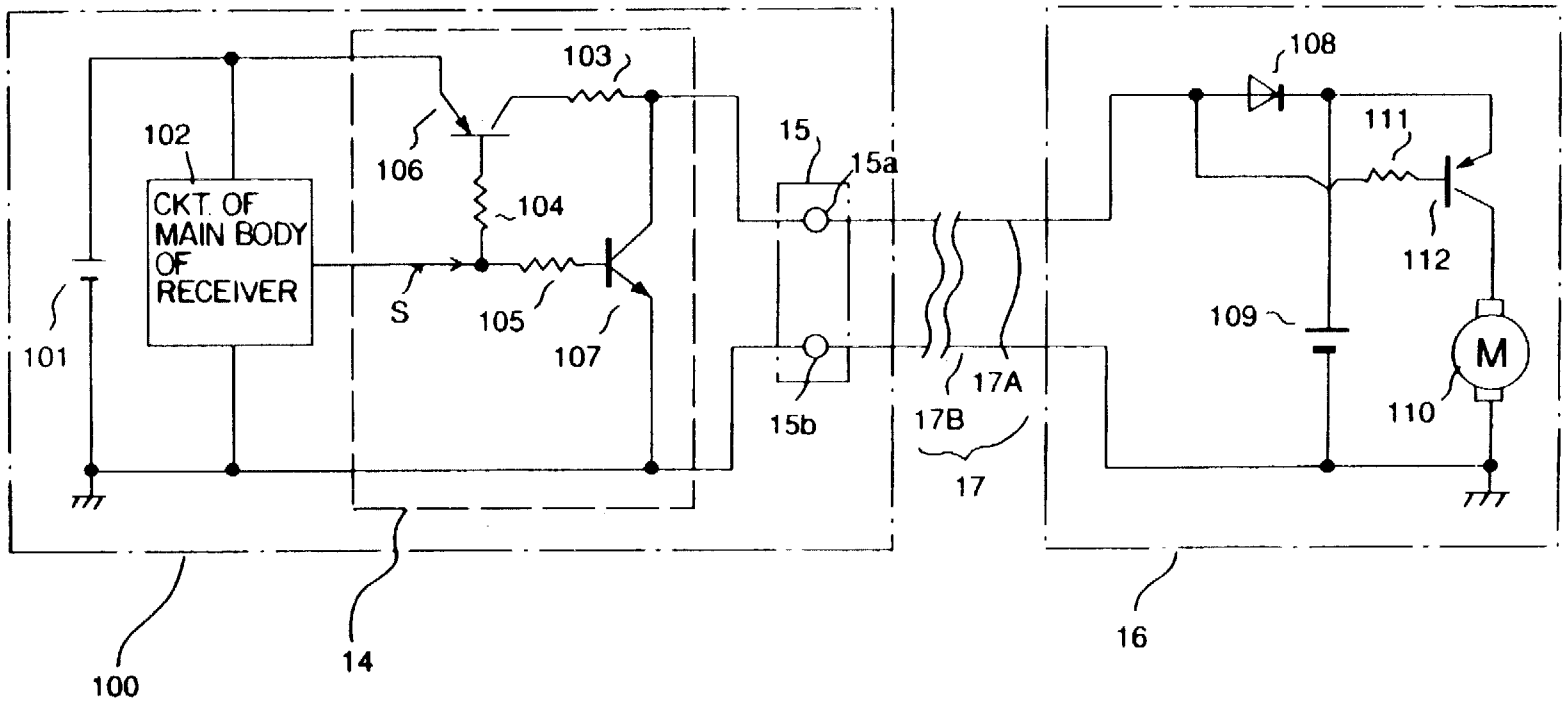
FIG. 2 is a circuit diagram of major sections of the main body of receiver and the vibration generation section.

Referring to FIG. 2, this vibration generation section 16 is connected electrically to the main body of receiver 100 with the connector 15 and the cord 17. The vibration section control section 14 in the main body of receiver drives the vibration generation section 16, which generates vibration and signals the fact that calling has occurred when a control signal from the CPU 6 is input into the vibration section control section 14.

Next, concrete configurations of the vibration section control section 14 and the vibration generation section 16 are explained.

FIG. 2 is the first circuit diagram showing each configuration of a part of the main body of receiver containing the vibration control section 14, and the vibration generation section 16.

In this figure, 100 is the main body of receiver, in which the battery 101 for a power source, the main body of receiver circuit 102 and the vibration section control section 14 are provided.

103 is a charge resistor and one end thereof is connected to the terminal 15*a* of the connector 15.

104 and 105 are resistors for current limitation and are connected to the side in which the control signal S from the main body of receiver circuit 102 is input.

106 is a PNP transistor and its base terminal is connected to the resistor 104, the emitter terminal is connected to the battery 101 and the collector terminal is connected to the terminal 15*a* through the charge resistor 103.

107 is an NPN transistor and its base terminal is connected to the resistor 105, the emitter terminal is connected to the terminal 15*b* and the collector terminal is connected to the terminal 15*a*.

The vibration section control section 14 is comprised of the charge resistor 103, the current limitation resistors 104 and 105, and the transistors 106 and 107.

Moreover, the signal S from the main body of receiver circuit 102 is supplied to each base of transistors 106 and 107 through the current limitation resistors 104 and 105.

17 is a cord connected to the connector 15, and comprised of the electric wire 17A for charging and controlling and the electric wire 17B for grounding.

108 is a diode for reverse current prevention and one end thereof is connected to the electric wire 17A.

109 is a secondary battery charged by the battery 101 and one end thereof is connected to the electric wire 17A through the diode 108 and another end is connected to the electric wire 17B.

110 is a motor for vibrator driven by the secondary battery 109.

111 is a resistor for current limitation and one end thereof is connected to the electric wire 17A.

112 is a PNP transistor, its base terminal is connected to the electric wire 17A through the resistor 111, the emitter terminal is connected to the diode 108 and the secondary battery 109 and the collector terminal is connected to the motor for vibrator 110.

The vibration generation section 16 is comprised of the diode 108, the secondary battery 109, the motor for vibrator 110, the resistor 111 and the transistor 112.

Moreover, the vibration generation section 16 is connected to the vibration section control section 14 by the cord 17 consisting of the electric wires 17A and 17B through the connector 15. Here, the electric wire 17B is grounded.

Figure 3:
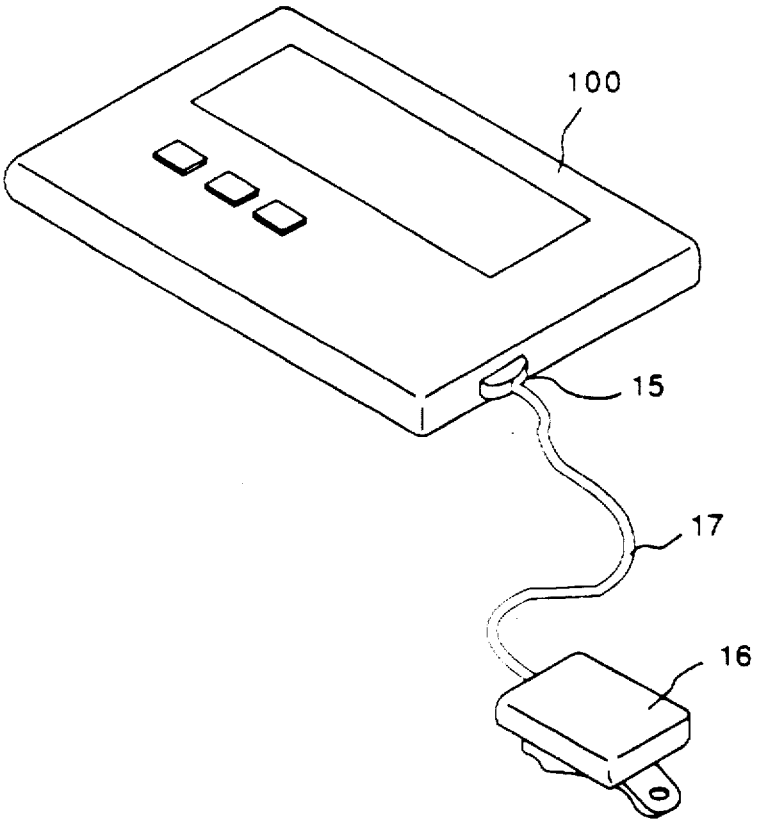
FIG. 3 is an outside drawing showing a state of connection of the main body of receiver and the vibration generation section.

FIG. 3 is an outside drawing showing that the vibration section control section 14 is connected to the vibration generation section 16 with the electric wire 17 and the connector 15.

Returning to FIG. 2, the signal S from the main body of receiver circuit 102 is at a low level "L" when the receiver is in waiting mode. When in this mode, the transistor 106 is turned on and the transistor 107 is turned off. Accordingly, power is supplied to the vibration generation section 16 through the connector 15 and the cord 17 from the battery 101 in the main body of receiver 100.

By this operation, the secondary battery 109 is supplied with power through the diode 108 and charging is carried out. As the transistor 112 is off, at this time, the motor for vibrator 110 is stopped and signalling by vibration is not performed.

Next, when the receiver receives its own call number the signal S from the main body of receiver circuit 102 changes to a high level "H", the transistor 106 turns off and the transistor 107 turns on. Therefore, power supply from the battery 101 to the vibration generation section 16 is stopped.

Also, the transistor 112 in the vibration generation section 16 turns on because the transistor 107 turns on and the electric wire 17A is grounded. The secondary battery 109 is connected with the motor for vibrator 110.

By this operation, the motor for vibrator 110 is driven by the power stored in the secondary battery 109. At this time, the diode 108 prevents the flow of reverse current from the secondary battery 109 to the electric wire 17A.

Like this, the vibration section control section 14, based on the signal S from the main body of receiver circuit 102, can carry out or stop charge to the secondary battery 109 provided in the vibration generation section 16 by connecting or disconnecting the battery 101 of the main body of receiver with the vibration generation section 16. Moreover, synchronized with the above operation and based on the signal S, the secondary battery 109 in the vibration generation section 16 and the motor for vibrator 110 can be disconnected.

Therefore, the cord 17 that connects the vibration generation section 16 to the main body of receiver 100 can work for charging or signaling by setting the electric wire 17B as a grounding line and switching the electric wire 17A by the vibration section control section 14.

By the above configuration, the off-the-shelf type cord of 2-line configuration can be adopted for the cord 17 for connecting the vibration generation section 16 with the main body of receiver 100. Additionally, a 2-pole configuration type can be adopted for the connector 15. As a result, reduction of the cost and miniaturization of connector become possible.

Next, the second embodiment is explained.

Figure 4:
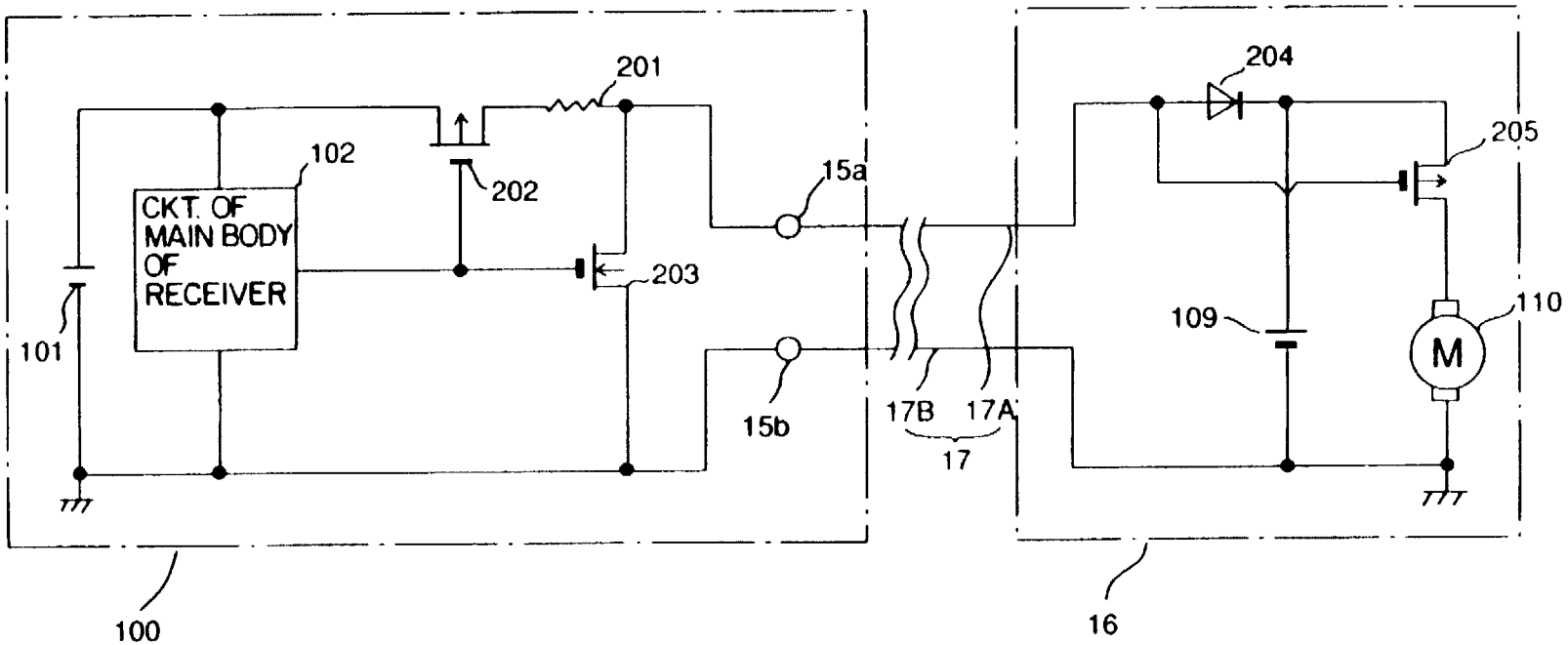
FIG. 4 is a circuit diagram of major sections of the main body of receiver and the vibration generation section.
Figure 5:
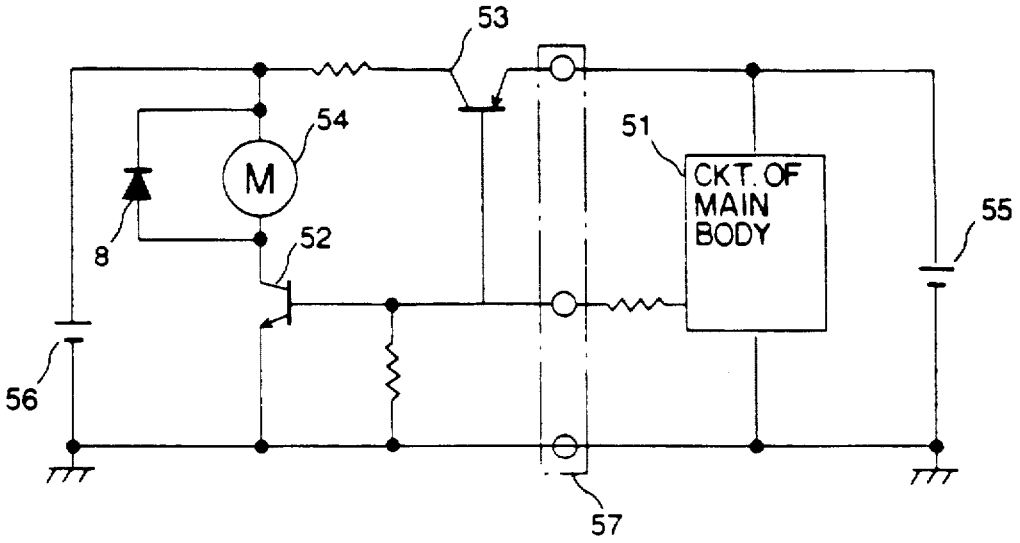
Fig. 5 PRIOR ART
FIG. 5 is a circuit diagram of a main body of receiver and a vibration generation section of a prior art.

FIG. 4 is a circuit diagram showing a configuration of the second embodiment. Where a component is the same as in the first embodiment, it is referred to by the same number and its detailed explanation is omitted.

201 is a charge resistor and one end thereof is connected to the terminal 15*a* of the connector 15.

202 is a P-channel FET and the gate terminal thereof is connected to the side where the control signal S from the main body of receiver circuit 102 is input into, the drain terminal is connected to the battery 101 and the source terminal is connected to the terminal 15*a* through the charge resistor 201.

203 is an N-channel FET and the gate terminal thereof is connected to the side where the control signal S from the main body of receiver circuit 102 is input into, the drain terminal is connected to the terminal 15*a* and the source terminal is connected to the terminal 15*b*.

The vibration section control section 14 consists of the charge resistor 201, the FET 202 and the FET 203.

Note that the signal S from the main body of receiver circuit 102 is supplied to the gate of the FET202 and the FET203.

204 is a diode for preventing reverse current and one end thereof is connected to the electric wire 17A.

205 is a P-channel FET and its gate terminal is connected to the electric wire 17A, the drain terminal is connected to the diode 204 and the secondary battery 109 and the source terminal is connected to the motor for vibrator 110.

The vibration generation section 16 consists of the secondary battery 109, the motor for vibrator 110, the diode 204 and the FET205.

As in the first embodiment the vibration generation section 16 is connected to the vibration section control section 14 by the cord 17 consisting of two electric wires 17A and 17B through the connector 15. Moreover, the electric wire 17B is earthed.

By configuring the device as above, the signal S from the main body of receiver circuit 102 becomes "L" level when the receiver is in waiting mode, and power is supplied to the vibration generation section 16 from the battery 101 of the main body of receiver 100 through the connector 15 and the cord 17 because the FET 202 turns on and the FET 203 turns off.

By this operation, the secondary battery 109 is supplied with power through the diode 204 and charging is carried out. Further, as the FET 205 is off then, the motor for vibrator 110 is stopped, so signalling by vibration is not carried out.

Next, when the receiver receives its own call number and the signal S from the main body of receiver circuit 102 becomes "H" level, the FET 202 turns off and the FET 203 turns on, so that the power supply from the battery 101 to the vibration generation section 16 is stopped.

Additionally, when the FET 203 turns on the electric wire 17A is grounded, so that the FET 205 in the vibration generation section 16 turns on and the secondary battery 109 is connected to the motor for vibrator 110.

By this operation, the motor for vibrator 110 is driven by the power stored in the secondary battery 109. At this time, the diode 204 prevents the flow of reverse current from the secondary battery 109 to the electric wire 17A.

Therefore, like the first embodiment, the vibration section control section 14, based on the signal S from the main body of receiver circuit 102, can carry out or stop charging the secondary battery 109 provided in the vibration generation section 16 by connecting or disconnecting the battery 101 in the main body of receiver. Moreover, synchronized with the above operation and based on the signal S, the secondary battery 109 in the vibration generation section 16 and the motor for vibrator 110 can be disconnected.

Therefore, the cord 17 that connects the vibration generation section 16 to the main body of receiver 100 can work for charging or signaling by setting the electric wire 17B as a grounding line and switching the electric wire 17A by the vibration section control section 14.

It is needless to say that transistors and FETs in the vibration section control section 14 and the vibration generation section 16 can be comprised by other kinds of switching elements than that of these embodiments.

What is claimed is:

1. A selective calling receiver comprising:

a receiver having a power source;

a vibration means having a secondary power source charged by said power source and a vibration generation source operated by said secondary power source;

connecting means for connecting said receiver and said vibration means, said connecting means consisting of a first wire for enabling said secondary power source to be charged and controlling operation of said vibration generation source; and a second wire for use as a ground wire.

2. The selective calling receiver of claim 1, wherein said receiver comprises:

a main body for transmitting a control signal when having received its own call number; and a first control means for enabling said power source to charge said secondary power source when said first control means is not receiving said control signal, and operating said vibration generation source when said first control means has received said control signal.

3. The selective calling receiver of claim 2, wherein said first control means comprises:

a first switching means, connected to an input side of said control signal, said power source and said first wire, for disconnecting said power source and said first wire when having received said control signal; and a second switching means, connected to an input side of said control signal, said first wire and said second wire, for connecting said first wire and said second wire when having received said control signal.

4. The selective calling receiver of claim 2, wherein said first control means comprises:

a first resistor having a first end connected to an input side of said control signal;

a second resistor having a first end connected to an input side of said control signal;

a third resistor having a first end connected to said first wire;

a first transistor of PNP type having a base terminal connected to a second end of said first resistor, an emitter terminal connected to a terminal of said power source and a collector terminal connected to a second end of said third resistor; and a second transistor of NPN type having a base terminal connected to a second end of said second resistor, an emitter terminal connected to said second wire and a collector terminal connected to said first wire.

5. The selective calling receiver of claim 2, wherein said first control means comprises:

a fourth resistor having a first end connected to said first wire;

a first field-effect transistor of P channel type having a gate terminal connected to an input side of said control signal, a drain terminal connected to a terminal of said power source and a source terminal connected to a second end of said fourth resistor; and a second field-effect transistor of N channel type having a gate terminal connected to an input side of said control signal, a drain terminal connected to said first wire and a source terminal connected to said second wire.

6. The selective calling receiver of claim 1, wherein said vibration means comprises a second control means for operating said vibration generation source by connecting said secondary source and said vibration generation source when charging to said secondary power source has been stopped.

7. The selective calling receiver of claim 6, wherein said second control means comprises a third switching means, which is connected to a side of said first wire, said secondary power source and said vibration generation source, for connecting said secondary power source and said vibration generation source when charging to said secondary power source has been stopped.

8. The selective calling receiver of claim 6, wherein said second control means comprises:

a first diode having a first end connected to said first wire;

a fifth resistor having a first end connected to said first wire;

a third transistor of PNP type having a base terminal connected to a second end of said fifth resistor, an emitter terminal connected to a second end of said diode and a terminal of said secondary power source, and a collector terminal connected to a terminal of said vibration generation source.

9. The selective calling receiver of claim 6, wherein said second control means comprises:

a second diode having a first end connected to said first wire;

a third field-effect transistor of P channel type having a gate terminal connected to said first wire, a drain terminal connected to a second end of said second diode and a terminal of said power source, and a source terminal connected to a side of said vibration generation source.

10. A selective calling receiver which is connected to a vibration means, said receiver comprising a power source, a main body which outputs a control signal to a control section to operate said vibration means when said main body receives its own call number, and connecting means for connecting said vibration means and said main body, said connecting means consisting of a first connecting terminal and a second connecting terminal, said control section comprising:

a first resistor having a first end connected to an input side of said control signal;

a second resistor having a first end connected to an input side of said control signal;

a third resistor having a first end connected to said first connecting terminal;

a transistor of PNP type having a base terminal connected to a second end of said first resistor, an emitter terminal connected to a terminal of said power source and a collector terminal connected to a second end of said third resistor; and a transistor of NPN type having a base terminal connected to a second end of said second resistor, an emitter terminal connected to said second connecting terminal and a collector terminal connected to said first connecting terminal.

11. A selective calling receiver which is connected to a vibration means, said receiver comprising a power source, a main body which outputs a control signal to a control section to operate said vibration means when said main body receives its own call number, and connecting means for connecting said vibration means and said main body, said connecting means consisting of a first connecting terminal and a second connecting terminal, said control section comprising:

a first resistor having a first end connected to said first connecting terminal;

a channel field-effect transistor of P type having a gate terminal connected to an input side of said control signal, a drain terminal connected to a terminal of said power source and a source terminal connected to a second end of said first resistor; and a channel field-effect transistor of N type having a gate terminal connected to an input side of said control signal, a drain terminal connected to said first terminal and a source terminal connected to said second terminal.

12. A selective calling receiver having a vibration means comprising:

connecting means for connecting said vibration means and a receiver, said connecting means consisting of a first wire and a second wire;

a secondary power source charged by a power source of said receiver;

a vibration generation source for generating vibration using said secondary power source;

a diode having a first end connected to said first wire;

a resistor having a first end connected to said first wire;

a transistor of PNP type having a base terminal connected to a second end of said resistor, an emitter terminal connected to a second end of said diode and said secondary power source, and a collector terminal connected to a terminal of said vibration generation source.

13. A selective calling receiver having a vibration means comprising:

connecting means for connecting said vibration means and a receiver, said connecting means consisting of a first wire and a second wire;

a secondary power source charged by a power source of said receiver;

a vibration generation source for generating vibration using said secondary power source;

a diode having a first end connected to said first wire;

a field-effect transistor of P channel type having a gate terminal connected to said first wire, a drain terminal connected to a second end of said diode and a terminal of said secondary power source, and a source terminal connected to a terminal of said vibration generating source.

14. A selective calling receiver comprising a main body, a vibration means, and connecting means for connecting said main body and said vibration means, said connecting means consisting of a first wire and a second wire;

said main body comprising a power source, a first connecting terminal, a second connecting terminal, a reception circuit for outputting a control signal when said main body receives its own call number, a first resistor having a first end connected to an input side of said control signal, a second resistor having a first end connected to an input side of said control signal, a third resistor having a first end connected to said first connecting terminal, a first transistor of PNP type having a base terminal connected to a second end of said first resistor, an emitter terminal connected to a terminal of said power source and a collector terminal connected to a second end of said third resistor, and a second transistor of NPN type having a base terminal connected to a second end of said second resistor, an emitter terminal connected to said second connecting terminal and a collector terminal connected to said first connecting terminal;

wherein said first wire is connected to said first connecting terminal and said second wire is connected to said second connecting terminal; and said vibration means comprising a secondary power source having a first terminal connected to said second wire and charged by said power source, a vibration generation source for generating vibration using said secondary power source, a diode having a first end connected to said first wire, a fourth resistor having a first end connected to said first wire, a third transistor of PNP type having a base terminal connected to a second end of said fourth resistor, an emitter terminal connected to a second end of said diode and a second terminal of said secondary power source, and a collector terminal connected to a terminal of said vibration generation source.

15. A selective calling receiver comprising a main body, a vibration means, and connecting means for connecting said main body and said vibration means, said connecting means consisting of a first wire and a second wire;

said main body comprising a power source, a first connecting terminal, a second connecting terminal, a reception circuit outputting a control signal when receiving its own call number, a first resistor having a first end connected to said first connecting terminal, a field-effect transistor of P channel type having a gate terminal connected to an input side of said control signal, a drain terminal connected to a terminal of said power source and a source terminal connected to a second end of said first resistor, and a field-effect transistor of N channel type having a gate terminal connected to an input side of said control signal, a drain terminal connected to said first terminal and a source terminal connected to said second terminal;

wherein said first wire is connected to said first connecting terminal and said second wire is connected to said second connecting terminal;

said vibration means comprising a secondary power source having a first terminal connected to said second wire and charged by said power source, a vibration generation source for generating vibration using said secondary power source, a diode having a first end connected to said first wire, a field-effect transistor of P channel type having a gate terminal connected to said first wire, a drain terminal connected to a second end of said diode and a terminal of said secondary power source, and a source terminal connected to a terminal of said vibration generation source.

16. A vibration system comprising:

a rechargeable power source and a vibration means operated using said rechargeable power source;

a control means for controlling charging of said rechargeable power source and operation of said vibration generation source;

connecting means for connecting said control means and said vibration means, said connecting means consisting of a first wire for connecting said control means and said vibration means; and and a second wire for connecting said control means and said vibration means;

wherein operation of said vibration generation source as well as charging of said rechargeable power source is controlled through said first wire and grounding is accomplished through said second wire.

17. The vibration system of claim 16, wherein said vibration means comprises:

a first diode having a first end connected to said first wire;

a first resistor having a first end connected to said first wire;

a first transistor of PNP type having a base terminal connected to a second end of said first resistor, an emitter terminal connected to a second end of said diode and a terminal of said secondary power source, and a collector terminal connected a terminal of said vibration generation source.

18. The vibration system of claim 16, wherein said vibration means comprises:

a second diode having a first end connected to said first wire; and a field-effect transistor of P channel type having a gate terminal connected to said first wire, a drain terminal connected to a second end of said second diode and a terminal of said secondary power source, and a source terminal connected to a terminal of said vibration generation source.

19. The vibration system of claim 16, wherein said control means comprises:

a control signal output section for outputting a control signal controlling said vibration means;

a second resistor having a first end connected to an input side of said control signal;

a third transistor having a first end connected to an input side of said control signal;

a fourth resistor having a first end connected to said first wire;

a second transistor of PNP type having a base terminal connected to a second end of side second resistor, an emitter terminal connected to a terminal of said power source and a collector terminal connected to a second end of said third resistor; and a third transistor of NPN type having a base terminal connected to a second end of said third resistor, an emitter terminal connected to said second wire and a collector terminal connected to said first wire.

20. The vibration system of claim 16, wherein said control means comprises:

a control signal output section for outputting a control signal controlling said vibration means;

a fifth resistor having a first end connected to said first wire;

a second field-effect transistor of P channel type having a gate terminal connected to an input side of said control signal, a drain terminal connected to a terminal of said power source and a source terminal connected to a second end of said fifth resistor; and a third field-effect transistor of N channel type having a gate terminal connected to an input side of said control signal, a drain terminal connected to said first wire and a source terminal connected to said second wire.

* * * * *